US008334786B2

(12) United States Patent
Bowles et al.

(10) Patent No.: US 8,334,786 B2
(45) Date of Patent: Dec. 18, 2012

(54) DOWN-HOLE WIRELESS COMMUNICATION SYSTEM

(75) Inventors: Adrian Robert Bowles, Farnborough (GB); Stuart John Eaton, Farnborough (GB); Timothy Rupert Charles Jarman, Farnborough (GB); Michael William Hopkins, Farnborough (GB)

(73) Assignee: Qinetiq Limited, London (GB)

( * ) Notice: Subject to any disclaimer, the term of this patent is extended or adjusted under 35 U.S.C. 154(b) by 422 days.

(21) Appl. No.: 12/674,067

(22) PCT Filed: Sep. 24, 2008

(86) PCT No.: PCT/GB2008/003217

§ 371 (c)(1),
(2), (4) Date: Feb. 18, 2010

(87) PCT Pub. No.: WO2009/040510

PCT Pub. Date: Apr. 2, 2009

(65) Prior Publication Data

US 2011/0163890 A1 Jul. 7, 2011

(30) Foreign Application Priority Data

Sep. 28, 2007 (GB) ..... 0718956.6

(51) Int. Cl.
*G01V 3/00* (2006.01)

(52) U.S. Cl. ..... 340/854.8; 340/853.1

(58) Field of Classification Search ..... 340/853.1, 340/854.8; 166/358, 250.11, 66.5
See application file for complete search history.

(56) References Cited

U.S. PATENT DOCUMENTS

| | | | | |
|---|---|---|---|---|
| 4,806,928 | A | 2/1989 | Veneruso | |
| 4,901,069 | A * | 2/1990 | Veneruso | 340/854.8 |
| 5,008,664 | A * | 4/1991 | More et al. | 340/854.8 |
| 5,455,573 | A * | 10/1995 | Delatorre | 340/854.8 |
| 7,140,434 | B2 * | 11/2006 | Chouzenoux et al. | 166/250.11 |
| 7,165,618 | B2 * | 1/2007 | Brockman et al. | 166/313 |
| 7,198,109 | B2 * | 4/2007 | Turner et al. | 166/374 |
| 7,411,517 | B2 | 8/2008 | Flanagan | |
| 7,414,405 | B2 * | 8/2008 | Moore | 324/338 |
| 7,436,184 | B2 * | 10/2008 | Moore | 324/347 |
| 2003/0058127 | A1 | 3/2003 | Babour et al. | |

(Continued)

FOREIGN PATENT DOCUMENTS

EP 1 609 947 A1 12/2005

(Continued)

OTHER PUBLICATIONS

International Search Report issued in International Application No. PCT/GB2008/003217; Mailed on May 11, 2009.

(Continued)

*Primary Examiner* — Jean B Jeanglaude
(74) *Attorney, Agent, or Firm* — Oliff & Berridge, PLC

(57) ABSTRACT

Apparatus for the wireless transmission of data, and preferably also of power, across a space between a length of production tubing and a surrounding casing in a petrochemical well, includes a pair of inductively-coupled coils, a first of which is located on the exterior of the production tubing generally coaxially therewith, and the second of which is located on the interior of the casing generally coaxially therewith. This may be used in particular as part of a system for transmitting power and data to/from a sensor monitoring the pressure and/or other environmental conditions within the "B" annulus B of a sub-sea well.

5 Claims, 2 Drawing Sheets

U.S. PATENT DOCUMENTS

| | | | |
|---|---|---|---|
| 2003/0066671 | A1 | 4/2003 | Vinegar et al. |
| 2004/0079525 | A1 | 4/2004 | Boyadjieff |
| 2004/0094303 | A1 | 5/2004 | Brockman et al. |
| 2006/0005965 | A1 | 1/2006 | Chouzenoux et al. |

FOREIGN PATENT DOCUMENTS

| | | | |
|---|---|---|---|
| GB | 2 415 109 | A | 12/2005 |
| WO | WO 00/60780 | A1 | 10/2000 |
| WO | WO 01/65067 | A1 | 9/2001 |
| WO | WO 2007/004891 | A1 | 1/2007 |
| WO | WO 2007/107734 | A1 | 9/2007 |

OTHER PUBLICATIONS

Great Britain Search Report issued in British Application No. 0718956.6; Searched on Jan. 22, 2008.

Written Opinion of the International Searching Authority issued in International Application No. PCT/GB2008/003217; Mailed on May 11, 2004.

* cited by examiner

DOWN-HOLE WIRELESS COMMUNICATION SYSTEM

The present invention relates to the wireless transmission of data, and preferably also of power, in a down-hole environment, and more particularly across the generally annular space between a length of production tubing and a surrounding casing in a petrochemical (oil or gas) well.

The invention is especially, though not exclusively, concerned with the transmission of data and power down-hole for the purpose of so-called B-annulus monitoring in a petrochemical well, and it is primarily in this context that the invention will be described hereinafter.

BACKGROUND

A typical oil or gas production well comprises lengths of steel production tubing through which the product is conveyed from the subterranean reservoirs(s) to the wellhead, surrounded by one or more generally coaxial tubular well casings. The outer casing is generally a concrete lining to the earth formations surrounding the wellbore, with one or more intermediate casings (particularly in the case of sub-sea wells) therebetween. Each circumjacent pair of tubular structures define a generally annular space between them, and these annuli are conventionally identified alphabetically as the A-annulus, B-annulus etc working outwards from the production tubing to the outer casing.

For the safe and efficient operation of such a well there is a need to monitor various environmental parameters down-hole and the production tubing is typically equipped on its exterior with various instrumentalities and cabling for powering, controlling and transmitting data from numerous sensors and tools associated with that tubing and the A-annulus. Monitoring of certain conditions within the B-annulus is also desirable and in particular it is important to monitor the pressure within that annulus to provide a warning of any leakage down-hole which may give rise to hazardous conditions. The temperature within that annulus may additionally or alternatively need to be monitored. Regulatory conditions prohibit penetration of the wellhead for measurement of B-annulus parameters, however, which means that one or more sensors have to be located in that annulus at a suitable down-hole position or positions. An electrical penetrator through the wall of the respective intermediate casing or other means can be used to communicate with such a sensor from the A-annulus. It is undesirable, however, to run a cable from topside to this position along the interior surface of the intermediate casing as the production tubing may need to be run into and out of the well on various occasions during its lifetime and may cause damage by collision with such cabling during the process. Furthermore since the production tubing itself will in any event usually be equipped with suitable cabling and gauge controllers or the like it should be more cost efficient to employ the same for communication also with the B-annulus pressure sensor(s), subject only to bridging the gap in communication across the width of the A-annulus. In the latter respect a hard wired connection is undesirable due to the likely need to withdraw the production tubing on occasion and the consequent difficulties of making and breaking the required connection, the possible presence of debris in that annulus, and the general need to avoid obstruction.

With the foregoing in mind, in one aspect the invention resides in apparatus for the wireless transmission of data across a generally annular space between a length of production tubing and a surrounding casing in a petrochemical well, comprising a pair of coils of different diameters adapted to be inductively coupled in a generally coaxial disposition, a first of which is adapted to be located on the production tubing generally coaxially therewith and the second of which is adapted to be located on the casing generally coaxially therewith.

In use the first coil is preferably located on the exterior of the production tubing and the second coil is preferably located on the interior of the casing.

Instrumentation may be associated with the second coil which in use is powered by inductive coupling from the first coil.

For the purposes of data transmission there may be means for applying a time-varying current to the first coil, means for modulating the load on the second coil, and means for detecting consequent amplitude modulation of the voltage across the first coil.

In the case of B-annulus pressure and/or temperature monitoring as described above, the first said coil can be associated with a reader on the exterior of the production tubing while the second said coil can be associated with a transponder on the interior of the intermediate casing, the latter receiving data from a B-annulus sensor or sensors which can be transmitted wirelessly from the transponder to the reader by virtue of the inductive coupling of the coils. By the same token, both the transponder and sensor(s) are preferably powered by the current induced in the second coil by the first, meaning that these can be "passive" devices requiring no other power source. It is also, however, within the scope of the invention for these to be "active" devices with a battery or other power source in other embodiments.

In another aspect the invention accordingly resides in a petrochemical well installation comprising: a length of production tubing; a first casing surrounding said tubing and defining therewith a first generally annular space ("A-annulus"); a second casing surrounding said first casing and defining therewith a second generally annular space ("B-annulus"); a sensor for sensing a parameter within the B-annulus; a transponder located on the interior of said first casing with a coil generally coaxial with said first casing; means providing signal communication between said sensor and transponder; and a reader located on the exterior of said tubing with a coil generally coaxial with said tubing; whereby in use said coils are inductively coupled across the A-annulus for the transmission of data from said sensor to said reader via said transponder.

BRIEF DESCRIPTION OF THE DRAWINGS

These and other aspects and features of the present invention will now be more particularly described, by way of example, with reference to the accompanying drawings, in which.

DETAILED DESCRIPTION OF THE INVENTION

Figure 1:
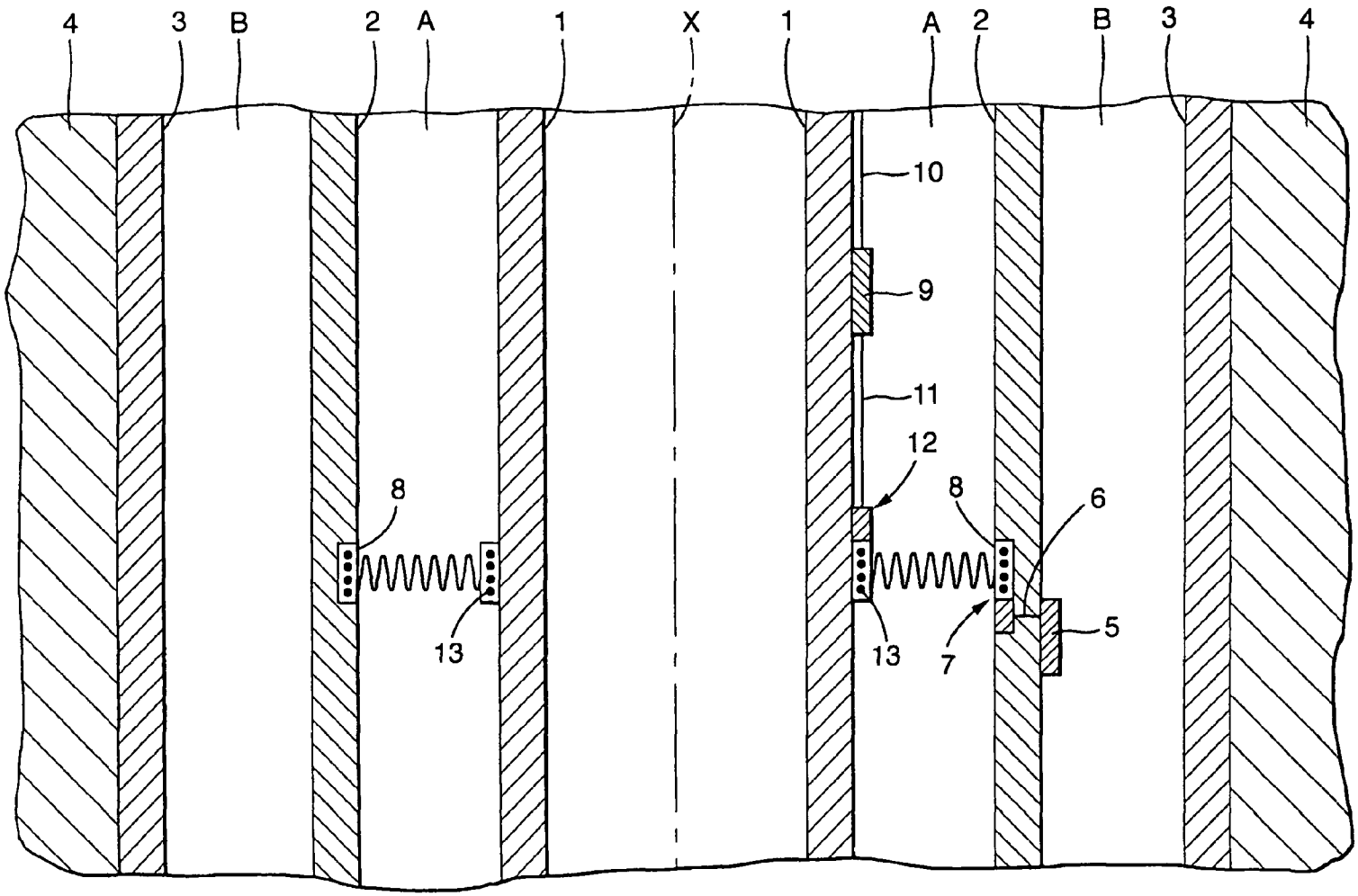
FIG. 1 is a schematic cross-section, not to scale, through part of a production oil or gas well equipped with a B-annulus pressure and/or temperature sensor and power and data transmission system according to one embodiment of the invention.

Referring to FIG. 1 there is shown a vertical section through a short length of down-hole production tubing 1 in an oil or gas well, being surrounded by an intermediate casing (also known as "production casing") 2 and outer casing 3, all centred substantially on the same axis X. The tubing 1 is typically steel with an outside diameter of 5½" (14 cm) or 7" (17.8 cm), the intermediate casing 2 is typically steel with an outside diameter of 9⅝" (24.5 cm) or 10¾" (27.3 cm), and the outer casing 3 is typically concrete with an inside diameter of 13⅜" (34 cm) or 14" (35.6 cm), the latter lining the earth formation 4 which surrounds the wellbore. The tubing 1 and casing 2 collectively define the A-annulus A, and the casing 2 and casing 3 collectively define the B-annulus B.

A sensor 5 is located on the outside surface of intermediate casing 2 for monitoring the pressure and/or temperature in annulus B, and is connected by a sealed and insulated electrical conductor ("penetrator") 6, which extends through that casing, to a transponder 7 located in a recess on the inside surface of that casing. The transponder 7 includes a coil (antenna) 8 which is wound around a former located in the recess on the interior of the intermediate casing 2, substantially coaxial with the axis X.

A gauge controller 9 is located on the outside surface of the production tubing 1 and is connected to a control station topside (not shown) by cabling 10 through which it receives power and command signals and through which it returns data from various instrumentation (not shown) within annulus A as well as from the sensor 5 in annulus B. In the context of the present invention the gauge controller 9 is also connected by a cable 11 to a reader 12 located on the outside surface of the tubing 1. The reader 12 includes a coil (antenna) 13 which is wound around a former located on the exterior of the tubing 1, substantially coaxial with the axis X.

As will be seen from FIG. 1, the coils 8 and 13 are substantially coaxial with one another and located at the same axial position along the length of the tubing 1 and casing 2, with coil 8 surrounding coil 13. In use they are inductively coupled to transfer power from the reader 12 to the transponder 7 and sensor 5 across the width of annulus A, and to transmit data in the opposite direction, as schematically illustrated by the notional waveforms in the Figure, and in this respect behave in a similar way to the coupling between the two windings of a loosely coupled transformer.

Figure 2:
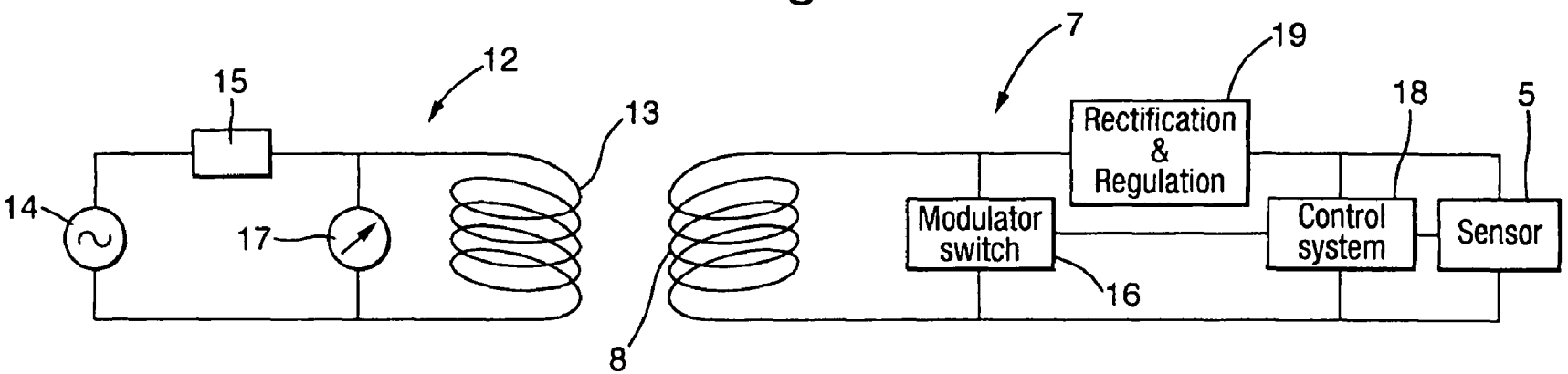
FIG. 2 is a schematic circuit diagram of the reader and transponder utilised in the system of FIG. 1.

More particularly, and with reference also to FIG. 2 (where for ease of illustration the two coils 13 and 8 are shown separated although in reality coil 13 is inside coil 8), when the gauge controller 9 requires a reading to be taken from the sensor 5, which may be intermittent or substantially continuous, it supplies a DC voltage to the reader 12 which is inverted by the reader to a time-varying waveform in the radio frequency band and applied to the coil 13. This is schematically illustrated in FIG. 2 by the AC source 14 with output impedance 15 connected to the coil 13. A predominantly magnetic field is generated, which in turn induces a voltage across the transponder's coil 8 to power the transponder 7 and sensor 5. The transponder coil's presence in the magnetic field of the reader coil 13 causes a dip in the voltage across the reader coil as would occur in two loosely coupled transformer windings when loading of the secondary will cause a resulting effect in the primary.

Data can be transferred from the transponder 7 to the reader 12 by altering the electrical impedance or resonant frequency of the transponder. This causes the load presented to the reader, and hence the voltage measured across the reader coil 13, to vary. The impedance value or tuned frequency can be switched by a simple field effect transistor (FED modulator switch 16 in the transponder 7, producing periodic amplitude modulated (AM) power fluctuations which are detected in the reader 12 by measuring the voltage across the coil 13 as schematically illustrated at 17. The received data can be transmitted from the reader 12 to the top of the pipe string via the cables 11, 10 as illustrated in FIG. 1 or by any other suitable conventional communication method.

The state of the sensor 5 can be measured by the transponder 7 using a microcontroller and/or analogue circuitry 18. The transponder electronics is powered using the voltage induced across the coil 8 which is rectified and regulated by a unit 19 within the transponder. The control circuitry 18 also converts the sensor data into a suitable binary form to apply to the switch 16.

The described method of operation can be termed a duplex system as data is transferred from the transponder to the reader at the same time as power is supplied from the reader to the transponder. In other embodiments a sequential operation could be employed, however, where data transfer from the transponder to the reader occurs in pauses between power supply from the reader to the transponder.

The above described system of power and data transfer between the reader 12 and transponder 7 is simple, effective and robust and the necessary hardware is minimally intrusive into annulus A. The transponder 7 and sensor 5 are "passive" devices in the sense that they require no battery or other power source apart from the inductive coupling with reader 12. This is important as once the well is completed there would be no practical access for routine battery replacement. In this respect the system may typically be required to have a service life of 20 years, and at down-hole temperatures in the region of 150° C.

The coaxial disposition of the two antenna coils 8 and 13 is an important advantage of the invention. The wireless communication enabled between them operates independently of the azimuthal location of the respective hardware around the axis X and, although the coils 8 and 13 are depicted as precisely circumjacent in FIG. 1, they can also be tolerant of some relative misalignment along the axis X—by several centimeters in the case of coils corresponding to the tubing and casing diameters exemplified above. This is particularly useful bearing in mind that in the process of well completion the intermediate casing 2 with transponder 7 will be installed first and the production tubing 1 with reader 12 will be installed separately and may be withdrawn and replaced several times during the life of the well. Neither of these tolerances would be possible in the case where, say, the coils were wound on radial axes and required to face each other across the annulus A in the same radial direction from axis X. Due to the shape of the generated magnetic field pattern the power transfer efficiency of inner and outer coaxial coils is also greater than that which could be achieved with in-line coils—typically 40% or more as compared to only a few percent. This level of efficiency can be maintained in the particular environment of metallic tubing 1 and casing 2 by use of known electromagnetic decoupling layers, e.g. ferrite, in proximity to the coils 8 and 13 if necessary, although by careful selection of the excitation frequency and geometries this may not be required. If necessary the former for the inner coil 13 can be configured to support that coil in a position somewhat stood off from the surface of the tubing 1 to reduce interactions of its field with the tubing and thereby increase the power transfer efficiency and the tolerance of the system to longitudinal misalignment between the coils, although it is preferred that the outer coil 8 is recessed within the casing 2 as shown, with a decoupling layer if required, in order to reduce the risk of damage from possible collisions with the production tubing when the latter is run in and out.

Although the coils 8 and 13 are depicted conventionally in the Figures as comprising several turns this is not necessarily required and the term "coil" is also to be regarded as embracing an antenna comprising a single loop, which at the diameters exemplified above may be all that is required.

The frequency band over which the above-described system may operate is typically within the range 50 kHz to 20 MHz and in some respects will depend on the medium to be encountered within the annulus A. Where this comprises seawater and/or drilling mud and hence has a significant electrical conductivity a frequency towards the lower end of this band may be optimal.

The invention claimed is:

1. A petrochemical well installation comprising: a length of production tubing; a first casing surrounding said tubing and defining therewith a first generally annular space ("A-annulus"); a second casing surrounding said first casing and defining therewith a second generally annular space ("B-annulus"); a sensor for sensing a parameter within the B-annulus; a first coil located on the interior of said first casing generally coaxial with said first casing; means providing signal communication between said sensor and first coil; and a second coil located on the exterior of said tubing generally coaxial with said tubing; whereby in use said coils are inductively coupled across the A-annulus for the transmission of data from said sensor to said second coil via said first coil.

2. An installation according to claim 1 wherein in use said sensor is powered by inductive coupling from said second coil to said first coil.

3. An installation according to claim 1 wherein a transponder is located on the interior of said first casing and operatively associated with said first coil, and a reader is located on the exterior of said tubing and operatively associated with said second coil.

4. An installation according to claim 3 wherein said reader comprises means for applying a time-varying current to said second coil, said transponder comprises means for modulating the load on said first coil in accordance with data from said sensor, and said reader comprises means for detecting consequent amplitude modulation of the voltage across said second coil.

5. An installation according to claim 3 wherein in use said transponder is powered by inductive coupling from said second coil to said first coil.

* * * * *